US008269119B2

(12) United States Patent
Grül et al.

(10) Patent No.: US 8,269,119 B2
(45) Date of Patent: Sep. 18, 2012

(54) APPARATUS FOR MUTUALLY LOCKING TWO SWITCHES, IN PARTICULAR CIRCUIT BREAKERS

(75) Inventors: Klaus Grül, Alfter (DE); Michel Hess, Winterthur (CH); Harald Krieger, Neuhaus (DE)

(73) Assignee: Siemens Aktiengesellschaft, Munich (DE)

( * ) Notice: Subject to any disclaimer, the term of this patent is extended or adjusted under 35 U.S.C. 154(b) by 132 days.

(21) Appl. No.: 12/770,815

(22) Filed: Apr. 30, 2010

(65) Prior Publication Data

US 2010/0276262 A1 Nov. 4, 2010

(30) Foreign Application Priority Data

May 4, 2009 (DE) ..... 10 2009 020 140

(51) Int. Cl.
*H01H 9/26* (2006.01)

(52) U.S. Cl. ..... 200/50.32

(58) Field of Classification Search ..... 200/50.28, 200/50.29, 50.32, 50.33, 50.37, 50.39
See application file for complete search history.

(56) References Cited

U.S. PATENT DOCUMENTS

| | | | | |
|---|---|---|---|---|
| 2,444,240 | A * | 6/1948 | Bayer | 200/50.37 |
| 2,646,474 | A | 7/1953 | Stratton | |
| 4,499,344 | A | 2/1985 | Castonguay | |
| 4,827,089 | A * | 5/1989 | Morris et al. | 200/50.33 |
| 4,924,041 | A * | 5/1990 | Yee | 200/50.33 |
| 5,436,415 | A | 7/1995 | Fogle et al. | |
| 5,847,339 | A * | 12/1998 | Kurono et al. | 200/50.32 |
| 6,486,421 | B1 * | 11/2002 | Jones et al. | 200/50.32 |
| 6,617,533 | B1 * | 9/2003 | Lawson et al. | 200/50.32 |
| 7,211,750 | B2 * | 5/2007 | Fillppenko | 200/50.32 |

FOREIGN PATENT DOCUMENTS

| | | |
|---|---|---|
| DE | 1 837 640 U | 9/1961 |
| DE | 199 00 219 B4 | 7/2006 |

* cited by examiner

*Primary Examiner* — Briggitte R Hammond
(74) *Attorney, Agent, or Firm* — Harness, Dickey & Pierce, P.L.C.

(57) ABSTRACT

An apparatus is disclosed for mutually locking two switches, in particular circuit breakers, with two plungers which move in opposition to one another via a forced mechanical coupling. When one switch opens, one plunger is shifted into its opening position and the other plunger is shifted into its locking position. In order to achieve a maintenance-free apparatus, at least one embodiment of the invention proposes that each plunger has a toothed rack, which meshes with a gearwheel, on which in each case one radial lever is arranged. The levers are connected in articulated fashion to one another via a connecting rod and a stop lever is mounted in rotary fashion on each gearwheel and, when the plungers are located in the zero position, bears in each case against a fixing stop. Furthermore, a driver is located on each gearwheel and bears in each case against a stop face formed on the stop lever, wherein, when a plunger is shifted, in particular when a switch opens, one driver pivots the stop lever towards a spring, while the other driver is removed from the stop face of the stop lever.

11 Claims, 4 Drawing Sheets

APPARATUS FOR MUTUALLY LOCKING TWO SWITCHES, IN PARTICULAR CIRCUIT BREAKERS

PRIORITY STATEMENT

The present application hereby claims priority under 35 U.S.C. §119 on German patent application number DE 10 2009 020 140.8 filed May 4, 2009, the entire contents of which are hereby incorporated herein by reference.

FIELD

At least one embodiment of the invention generally relates to an apparatus for mutually locking two switches, in particular circuit breakers.

BACKGROUND

Mutual locks, in particular as an accessory, are known for circuit breaker configurations with, for example, two switches arranged next to one another. The interface between the circuit breaker and the lock is in this case often formed by a disk cam/plunger mechanism. The disk cam can be integrated in a drive shaft within the switch; the lock is driven or the switch is prevented from opening via the disk cam. In the process, the plunger enters the circuit breaker and forms the connecting element between the internal disk cam and the external lock.

For mutual locking of the two switches, two plungers are used which are capable of moving in opposition to one another in the longitudinal direction of the plunger via a forced mechanical coupling. When a circuit breaker opens, the plunger thereof is pushed by the disk cam out of its zero position into its opening position out of the circuit breaker. At the same time, the other plunger is pushed out of its zero position into the other circuit breaker by the forced coupling, i.e. is shifted into its locking position. When the plunger has reached the locking position, the associated circuit breaker is blocked and it is therefore no longer possible for the circuit breaker to open.

It is necessary for correct operation for the contact faces of the disk cam and the plunger to each be located at precisely predetermined positions. A deviation from this is only possible within tight tolerance ranges, which results in considerable sensitivity to manufacturing tolerances and wear. In order to make an adjustment, the positions of the disk cam and the plunger each need to be readjusted.

SUMMARY

In at least one embodiment of the invention, a maintenance-free apparatus is proposed for mutually locking two circuit breakers.

At least one embodiment proposes that each plunger has a toothed rack, which runs in the longitudinal direction of the plunger, and the two toothed racks are arranged substantially parallel to one another and facing away from one another, that each toothed rack meshes with a gearwheel, on which in each case one lever, which runs radially outwards, is arranged fixedly, that the two lever ends are connected to one another in articulated fashion via a connecting rod, and the length of the connecting rod corresponds to the distance between the two gearwheels, that a stop lever is mounted in rotary fashion on each gearwheel and, when the plungers are located in the zero position, bears in each case against a fixing stop, in that a driver is arranged fixedly on each gearwheel and, when the plungers are located in the zero position, bears in each case against a stop face formed on the stop lever, and that, when a plunger is shifted out of the zero position, in particular when a switch opens, one driver pivots the stop lever counter to an elastic force, while the other driver is removed from the stop face of the stop lever, which in the process continues to remain in its position on the fixing stop.

In at least one embodiment, when the connecting rod has been adjusted correctly, the two drivers therefore each bear against their stop face. If there is a shift out of the zero position, one of the two drivers is pushed via the connecting rod against its stop lever and therefore counter to the elastic counterforce. Neither the gearwheels nor the radially outwardly running levers can move in the rest state, i.e. when the plungers are located in the zero position; the plungers are so to speak "trapped" in their zero position. In the rest state, the plungers are held by the lock in their zero position.

In at least one embodiment, the fixing stop in the process forms a mechanical stop, whose position is defined precisely and is independent of the elasticity constant of the elastic counterforce. As a result, the restoring force in the event of small deflections out of the zero position is proportional to the prestress and can be selected virtually as desired. By using a fixing stop for the elastic counterforce, it is possible to adjust a prestress and thus to fix precisely and also to hold the plunger position in the rest state, i.e. in the zero position.

A technically simple embodiment envisages that the elastic counterforce is generated in each case by a tension spring.

As few different parts as possible are required if when the plungers are located in the zero position, based on the central plane thereof, the plungers, the toothed racks, the gearwheels, the levers, the stop levers, the tension springs, the fixing stops, the drivers and the stop faces are arranged in mirror-symmetrical fashion with respect to one another.

A compact design can be achieved if the stop levers are in the form of angled levers, and the gearwheel and the angled lever, which is mounted in rotary fashion on the gearwheel, each have a common axis of rotation.

Manufacturing tolerances can be eliminated if the length of the connecting rod is adjustable.

In a technically simple embodiment, the plungers with their toothed racks each interact with a disk cam of the switch.

BRIEF DESCRIPTION OF THE DRAWINGS

Embodiments of the invention will be described in more detail below with reference to a drawing, in which.

DETAILED DESCRIPTION OF THE EXAMPLE EMBODIMENTS

Figure 1:
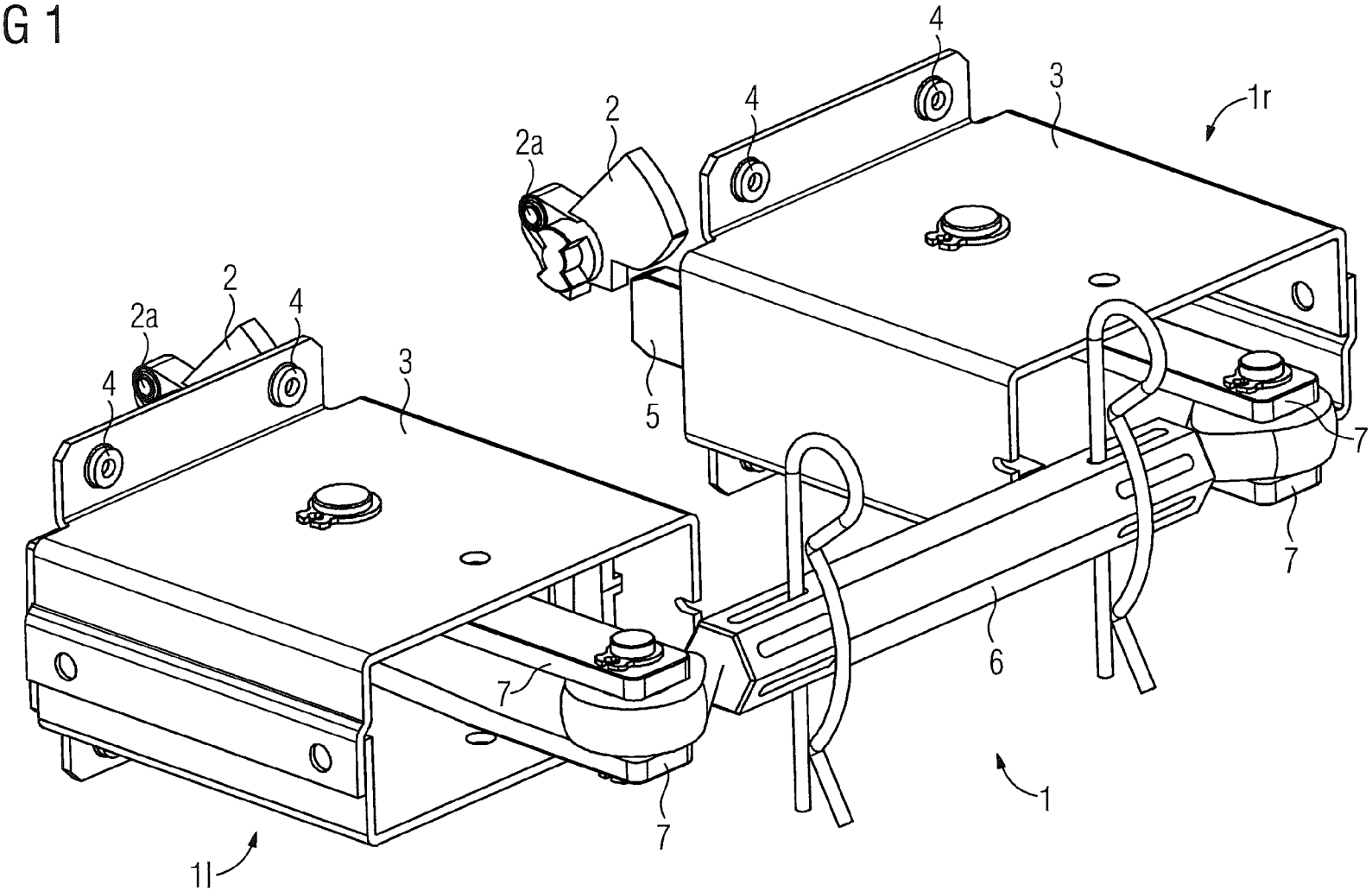
FIG. 1 shows an apparatus for mutually locking two switches with protective covers.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an apparatus 1 for mutually locking two circuit breakers, referred to as switches below. For reasons of simplicity, only the disk cam 2 of the two switches is shown in FIG. 1, said disk cam being capable of being pivoted about a spindle 2*a* via a drive shaft (likewise not shown) of the switch.

The two switches are generally fastened next to one another on a corresponding mounting plate. The disk cam 2 (shown on the left-hand side in relation to FIG. 1) therefore belongs to the left-hand switch and the right-hand disk cam 2 belongs to the right-hand switch. The apparatus comprises two components, with one component 11 being associated with the left-hand switch and one component being associated with the right-hand switch. The two components 11, 1*r* each have a frame 13, which in this case at the same time acts as a protective cover 3. They are fastened on the outside on the rear side of the switch on the mounting plate by means of a corresponding fastening plate (for example angled plate). FIG. 1 shows through-holes 4 for the fastening screws for mounting the components 11, 1*r* on the fastening plate.

The plungers 5 each protrude into the switches and interact with the disk cam 2 of the switch. The two components 11 and 1*r* are connected by a connecting rod 6, which is connected in articulated fashion to the lever ends of two levers 7 protruding out of the protective cover 3.

Figure 2:
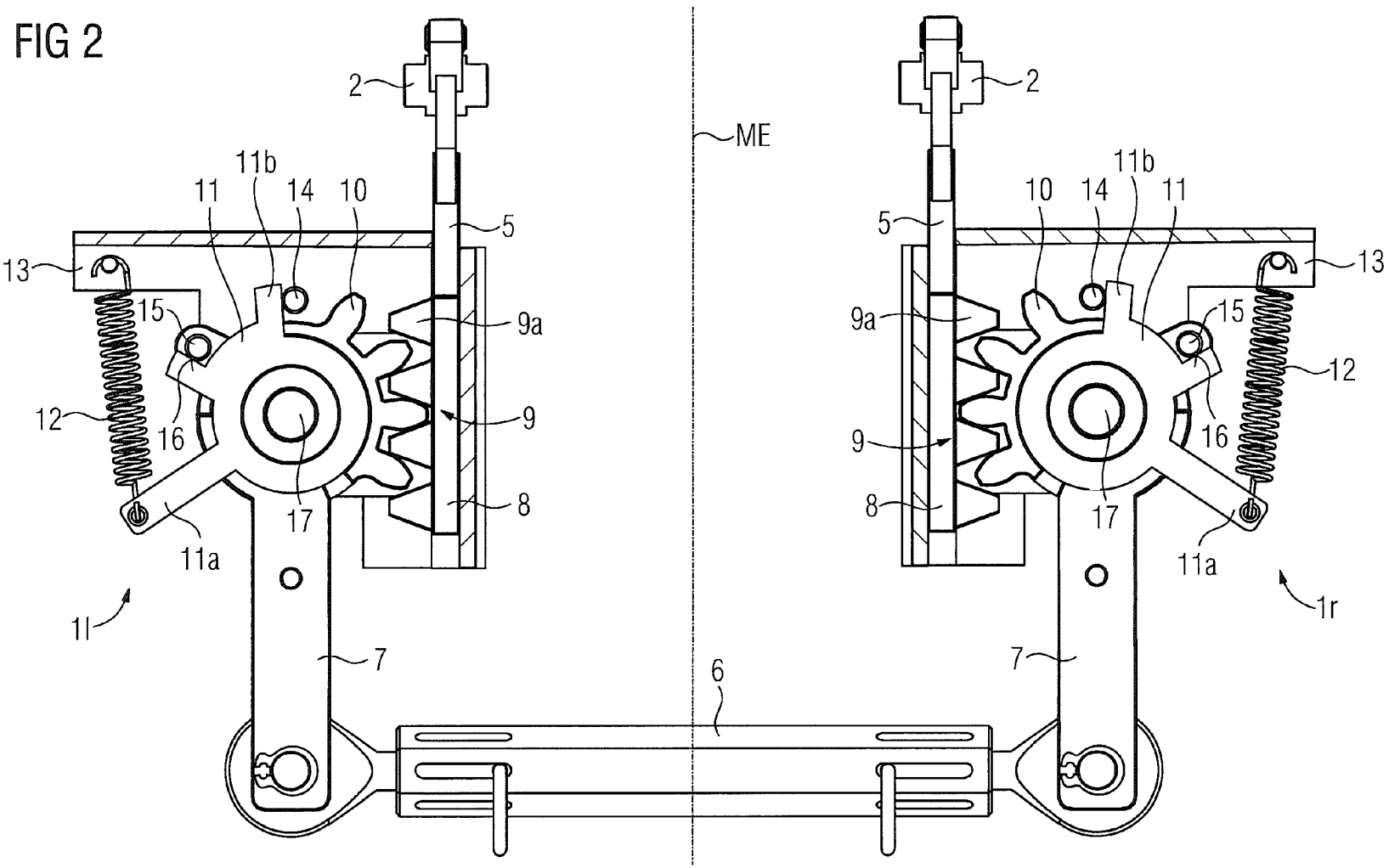
FIG. 2 shows a plan view of the apparatus shown in FIG. 1 without the protective covers.

The way in which the apparatus operates will be explained below with reference to FIG. 2, which shows the apparatus shown in FIG. 1 in a plan view, wherein, for simplification, an illustration with a mirror-symmetrical arrangement with respect to the central plane ME has been chosen. In other words: FIG. 2 shows the component 11 (correct) from above and the component 1*r*, but from below. FIG. 2 shows that the two plungers 5 run (substantially) parallel to one another and are formed as toothed racks 9 at that end 8 which faces away from the disk cam 2, with teeth 9*a* facing away from one another. Each toothed rack 9 meshes with a gearwheel 10, on which a radially outwardly running lever 7 is integrally formed. The two lever ends (as already shown in FIG. 1) are connected to one another in articulated fashion via the connecting rod 6. The plungers 5 are located in their zero position, i.e. in the rest state, in FIG. 2. The two switches in FIG. 2 are open.

The articulated connection via the connecting rod 6 brings about a forced mechanical coupling between the two plungers 5, which in this case move in opposition to one another in the longitudinal direction of the plungers.

Furthermore, a stop lever 11 in the form of an angled lever is mounted in rotary fashion on each gearwheel 10 and has a common axis of rotation with the gearwheel 10, but is capable of being pivoted independently thereof. One lever end 11*a* is fastened on one end of a tension spring 12 in order to generate an elastic counterforce, the other end of said tension spring 12 being supported on the frame 13. The other lever end 11*b* bears against a fixing stop 14 in the form of a round pin, which is likewise arranged fixedly on the frame 13. The bearing arrangement against the fixing stop 14 is brought about when the two plungers 5 are in the zero position by a slight force being applied; the tension springs 12 are prestressed in FIG. 2 (the tension springs 12 draw the stop lever 11 towards the fixing stop). The effective spring force corresponds to the structurally fixed prestress. Furthermore, FIG. 2 shows two drivers 15, which are arranged fixedly on the gearwheels and bear against a stop face 16 of the stop lever 11, without a force being applied when the plungers 5 are located in the zero position in FIG. 2 (virtually with negligible force).

The length of the connecting rod 6 corresponds to the distance between the two gearwheels 10, i.e. the length is in this case selected to be identical to the distance, wherein the length of the connecting rod 6 can be varied for precise adjustment purposes. The length is adjusted in such a way that the lever ends 11*b* are located on the fixing stop 14 and the drivers 15 are located on the stop face 16.

Figure 4:
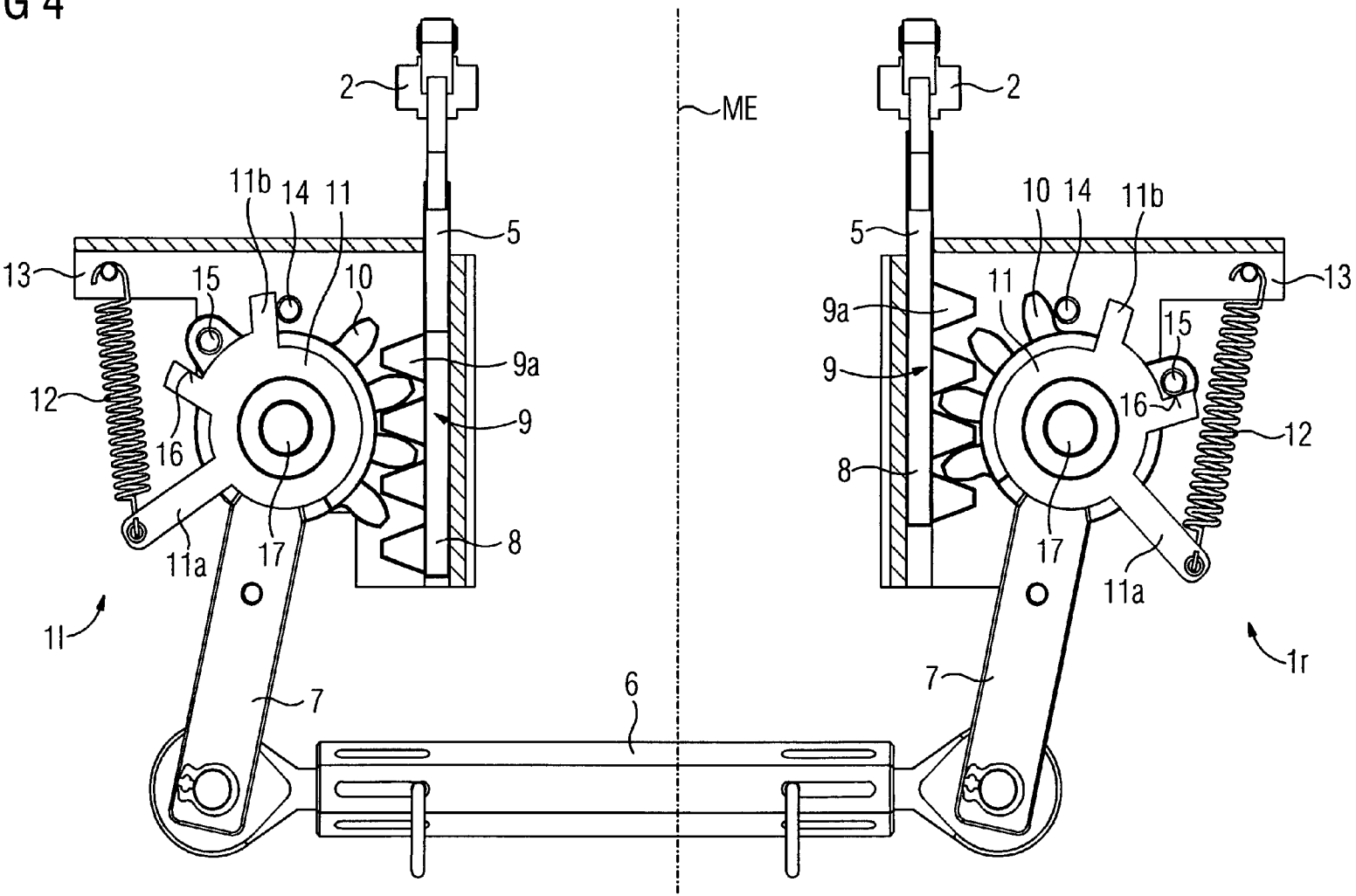
FIG. 4 shows a plan view of the apparatus shown in FIG. 1 without the protective covers.

If one of the two plungers 5 is pushed by one of the two disk cams 2 out of its zero position slightly out of the switch, the left-hand plunger 5 in FIG. 4 therefore moves downwards, and the stop lever 11 remains in its position in which it bears against the fixing stop 14. The other plunger 5 is pushed by the forced coupling correspondingly into the switch, into its locking position (FIG. 4) in which this switch is prevented from opening.

At the same time, the driver 15, via the lever 7 and the connecting rod 6 on the right-hand side in FIG. 4 (right-hand component 1*r*), pushes the stop lever 11 against the tension spring 12, as a result of which said stop lever 11 pivots and the tension spring 12 is stressed.

Figure 3:
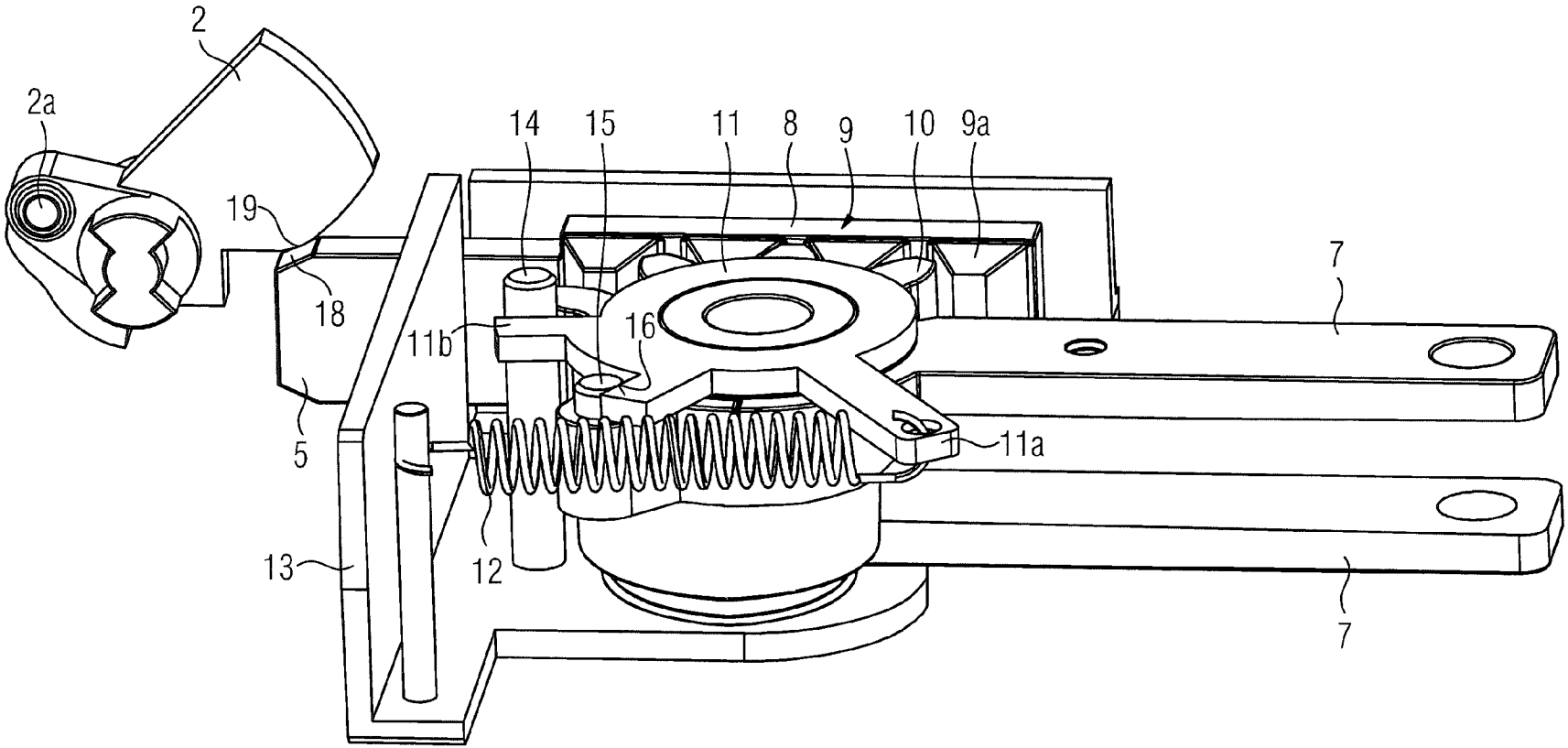
FIG. 3 shows that part of the apparatus shown on the left in FIG. 2, in a three-dimensional illustration from the side.

When the plungers 5 are located in the zero position (as shown in FIGS. 1-3), the plungers 5, the toothed racks 9, the gearwheels 10, the levers 7, the stop levers 11, the tension springs 12, the drivers 15 and the stop faces 16 are arranged in mirror-symmetrical fashion with respect to one another (see above), in relation to the central plane ME, wherein the central plane ME runs perpendicular to the plane of the drawing in FIG. 2 in the center between the two components 11, 1*r* and therefore the two plungers 5.

FIG. 3 shows the left-hand part 11 (from FIGS. 1 and 2) in a three-dimensional illustration from the side. The interaction between the disk cam 2 and the plunger 5 takes place via sloping contact faces 18 and 19 at the plunger end or on the disk cam 2, wherein pivoting of the disk cam 2 pushes the plunger 5 in each case out of the switch into the component 11 or 1*r* during opening of the switch.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for mutually locking two switches, comprising:

two plungers, each of the two plungers engaging in one of the two switches and moving in a longitudinal direction of the plunger in opposition to one another via a forced mechanical coupling, wherein when one of the two switches opens, the plunger which engages into said one of the two switches is shifted out of its zero position into its opening position, and the plunger which engages into the other of the two switches is shifted out of its zero position into its locking position, wherein each of the two plungers includes a toothed rack, which runs in the longitudinal direction of the plunger, the two toothed racks being arranged substantially parallel to one another and facing away from one another, each toothed rack meshing with a gearwheel, on which a respective lever, which runs radially outwards, is arranged fixedly, wherein ends of the respective levers are connected to one another in articulated fashion via a connecting rod, a length of the connecting rod corresponding to a distance between the two gearwheels, wherein a stop lever is mounted in rotary fashion on each gearwheel and, when the plungers are located in the zero position, bears in each case against a fixing stop, wherein a driver is arranged fixedly on each gearwheel and, when the plungers are located in the zero position, bears in each case against a stop face formed on the stop lever, and wherein, when a plunger is shifted out of the zero position, one driver pivots the stop lever counter to an elastic force, while another driver is removed from the stop face of the stop lever, which in the process continues to remain in its position on the fixing stop.

2. The apparatus as claimed in claim 1, wherein the elastic counterforce is generated in each case by a tension spring.

3. The apparatus as claimed in claim 1, wherein, when the plungers are located in the zero position, based on the central plane thereof, the plungers, the toothed racks, the gearwheels, the levers, the stop levers, the tension springs, the fixing stops, the drivers and the stop faces are arranged in mirror-symmetrical fashion with respect to one another.

4. The apparatus as claimed in claim 1, wherein the stop levers are in the form of angled levers, and the gearwheel and the stop lever, mounted in rotary fashion on said gearwheel, each have a common axis of rotation.

5. The apparatus as claimed in claim 1, wherein a length of the connecting rod is adjustable.

6. The apparatus as claimed in claim 1, wherein the plungers with their toothed racks each interact with a disk cam of the switch.

7. The apparatus as claimed in claim 1, wherein the mutually locking two switches are circuit breakers.

8. The apparatus as claimed in claim 2, wherein, when the plungers are located in the zero position, based on the central plane thereof, the plungers, the toothed racks, the gearwheels, the levers, the stop levers, the tension springs, the fixing stops, the drivers and the stop faces are arranged in mirror-symmetrical fashion with respect to one another.

9. The apparatus as claimed in claim 2, wherein the stop levers are in the form of angled levers, and the gearwheel and the stop lever, mounted in rotary fashion on said gearwheel, each have a common axis of rotation.

10. The apparatus as claimed in claim 2, wherein a length of the connecting rod is adjustable.

11. The apparatus as claimed in claim 2, wherein the plungers with their toothed racks each interact with a disk cam of the switch.

* * * * *